US012005542B2

(12) United States Patent
Valentini

(10) Patent No.: US 12,005,542 B2
(45) Date of Patent: Jun. 11, 2024

(54) HAND-HELD POWER TOOL FOR SENDING OR POLISHING A WORKPIECE

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 770 days.

(21) Appl. No.: 16/852,778

(22) Filed: Apr. 20, 2020

(65) Prior Publication Data

US 2020/0384596 A1 Dec. 10, 2020

(30) Foreign Application Priority Data

May 7, 2019 (EP) ..... 19172989

(51) Int. Cl.
*B24B 23/02* (2006.01)
*B24B 23/03* (2006.01)
*B24B 47/12* (2006.01)

(52) U.S. Cl.
CPC ..... *B24B 23/022* (2013.01); *B24B 23/03* (2013.01); *B24B 47/12* (2013.01)

(58) Field of Classification Search
CPC ..... B24B 23/03; B24B 47/12; B24B 23/04; B24B 45/006; B24B 41/044; B24B 23/02; B24B 23/022; B24B 41/007; B24D 9/08; B25F 5/006
USPC ..... 451/357, 270, 159
See application file for complete search history.

(56) References Cited

U.S. PATENT DOCUMENTS 8,740,672 B2 * 6/2014 Kawamata ..... B24B 45/00 451/342

FOREIGN PATENT DOCUMENTS

| | | | | |
|---|---|---|---|---|
| EP | 0320599 B1 | | 6/1991 | |
| EP | 0 694 365 A1 | | 1/1996 | |
| EP | 1 277 544 A2 | | 1/2003 | |
| EP | 1 714 739 A1 | | 10/2006 | |
| EP | 1 745 887 A1 | | 1/2007 | |
| EP | 1894674 A1 | | 3/2008 | |
| EP | 2 735 402 A1 | | 5/2014 | |
| EP | 2735402 A1 | * | 5/2014 | ..... B24B 23/04 |
| JP | S59 69844 U | | 5/1984 | |
| JP | 2003145404 A | | 5/2003 | |
| JP | 2008055559 A | | 3/2008 | |

(Continued)

OTHER PUBLICATIONS

English language Abstract of EP0320599B1.
English language Abstract of JPS5969844U.
English translation of JP2003145404A.

*Primary Examiner* — Eric J Rosen
*Assistant Examiner* — Sharonda T Felton
(74) *Attorney, Agent, or Firm* — Ware, Fressola, Maguire & Barber LLP

(57) ABSTRACT

A hand-held power tool for sanding or polishing a working surface of a workpiece features a backing pad supported in respect to a housing in a manner freely rotatable about a longitudinal axis extending perpendicular to an extension plane of the backing pad. The housing or backing pad includes first magnetic elements spaced apart from each other in a direction extending parallel to the extension plane, and includes a second magnetic element located in a space between the first magnetic elements in such a manner that the second magnetic element is held at a distance to the first magnetic elements by a magnetic force when a motor of the power tool is running and the power tool is in an idle state, thereby limiting the movement of the backing pad to an orbital movement.

19 Claims, 5 Drawing Sheets

(56) References Cited

FOREIGN PATENT DOCUMENTS

WO 2014/023229 A1 2/2014

* cited by examiner

Prior Art

HAND-HELD POWER TOOL FOR SENDING OR POLISHING A WORKPIECE

Figure 1:
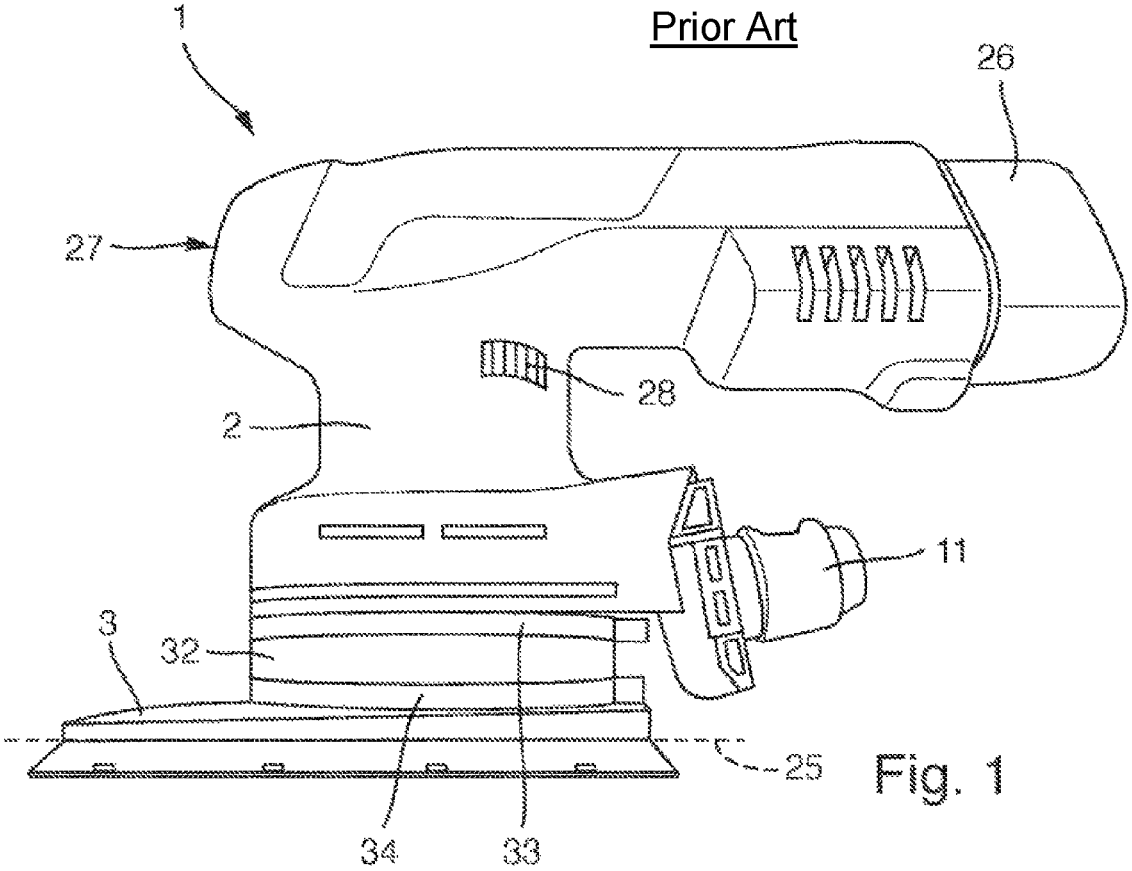
Fig. 1 Prior Art

The present invention refers to a hand-held power tool for sanding or polishing a working surface of a workpiece. The power tool comprises a housing and a backing pad adapted for performing an orbital or a random-orbital movement in an extension plane of the backing pad in respect to the housing during intended use of the power tool. The power tool further comprises in the housing a motor with a motor shaft adapted for performing a rotational movement about an axis of rotation, and means for transforming the rotational movement of the shaft into the orbital or random orb ital. movement of the backing pad.

Such power tools are well-known in the prior art, for example as orbital sanders or orbital polishers. The term "hand-held" refers to the reduced size of the tool and no to how it is held or guided during its intended use. Therefore, the tool does not necessarily have to be held in the hand of a user during its intended use, but may well be held by or fixed to a distal end of a robot arm. During the intended use of the tool the user or the robot guide the power tool with a sanding or polishing member attached to the bottom surface of the backing pad over a surface to be worked, that is sanded or polished. The surface may be, for example, a vehicle body or an aircraft or watercraft hull. The backing pad seen in a plan view may have almost any form. In particular, it may have a circular, rectangular, quadratic or triangular form. An orbital polisher with a backing pad having the form of an isosceles triangle with the corners of the triangle being interconnected by convex lines arched to the outside, called a delta sander with a delta-shaped backing pad, is also well-known in the art.

The backing pad may comprise a planar base plate made of a rigid material (e.g. plastic and/or metal) and a planar absorption plate made of a resilient material (e.g. soft plastic or rubber) and attached to a bottom surface of the base plate. Of course, other embodiments of the backing pad are possible, too. An abrasive or polishing member is releasably attached to a bottom surface of the backing pad, for example by means of a hook-and-loop (e.g. Velcro®)-fastener. The abrasive member may comprise a sanding paper or fabric. The polishing member may comprise a pad made of a foamed material, wool, fabric, microfibre or the like.

In the prior art magnetic force is only used for attachment of an abrasive or polishing member to a bottom surface of a backing pad or of a backing pad to the rest of the power tool (e.g. to a vibration head) or for permitting rotation of a delta-shaped backing pad in respect to the housing of a power tool by pre-defined angles (e.g. 30°, 45°, 60° or) 90°. Prior art reference EP 1 007 282 B2 describes a power tool with a magnetized backing pad to which an abrasive member comprising a ferromagnetic metal foil can be releasably attached. EP 1 552 904 A1 describes a power tool with a backing pad having a magnetized coupling member and a respective abrasive member which can be releasably attached to the backing member. To this end, it is suggested that the abrasive member comprises a corresponding coupling member made of ferromagnetic material. DE 40 11 761 A1 describes a torque-proof attachment of a magnetized backing pad to a magnetized plate of a vibration head of the tool. Reference EP 2 735 402 A1 describes a delta-sander where the backing pad can be rotated in respect to the housing for example by 120° wherein the backing pad is held in the discrete rotational position by magnetic force. Respective magnetic elements are located at the housing and the backing pad, respectively, spaced apart from each other in a direction extending essentially perpendicular to the plane of movement and the extension plane of the backing pad.

Reference is made to a power tool which, for example but not limited to, is an orbital sander or polisher in which the backing pad is eccentrically mounted in respect to the axis of rotation of the motor shaft. Rotation of the motor shaft is transformed into an orbital or random orbital movement of the backing pad by means of transforming means in the form of an eccentric element. The motor shaft (or any other shaft in connection with the motor shaft) is attached to the eccentric element in a torque proof manner. A guiding pin assigned to the backing pad is supported in the eccentric element in a freely rotatable manner. The backing pad of such a power tool would perform a random orbital movement. Therefore, in the prior art conventional mechanical means are provided in order to prevent free rotation of the guiding pin in respect to the eccentric element and to allow only a slight rotational movement of the backing pad in respect to the eccentric element. This prevents the backing pad from performing a random orbital movement and limits the movement of the backing pad to an orbital movement. An orbital movement means that the backing pad moves two-dimensionally in its plane of extension, i.e. only forward and backward as well as to both sides, whereby a free rotation of the backing pad about the guiding pin is prevented.

For example, in the known orbital sander "Festool DTS 400" and similar power tools from German based company Festool GmbH the mechanical means for preventing the backing pad from freely rotating in respect to the housing of the power tool are embodied as a rubber band bridging a gap between a top surface of the backing pad and a bottom part of the housing facing the top surface of the backing pad, the rubber band being connected to the housing as well as to the backing pad. Due to the rubber band only a restricted rotational movement of the backing pad in respect to the housing is possible. Furthermore, the elasticity of the rubber band allows the eccentric movement of the backing pad in the plane of extension of the backing pad. However, the mechanical connection between the housing and the orbiting backing pad leads to a power loss and adversely affects the efficiency of the power tool.

Therefore, there is clearly a need for a hand-guided power tool with a backing pad for sanding and/or polishing workpieces with enhanced efficiency, in which the backing pad performs an orbital movement.

In accordance with the present invention this object is achieved by a power tool with the features of claim 1. In particular, starting from a power tool of the above-identified kind, it is suggested that the backing pad is supported in respect to the housing of the power tool in a manner freely rotatable about a longitudinal axis extending perpendicular to the extension plane of the backing pad, and the housing or the backing pad comprises at least two first magnetic elements spaced apart from each other in a direction extending parallel to the extension plane of the backing pad, and the backing pad or the housing comprises at least one second magnetic element located in a space between at least two of the first magnetic elements in such a manner that the at least one second magnetic element is held at a distance to the at least two first magnetic elements by means of magnetic force at least when the motor of the power tool is running and the power tool is in an idle state, thereby limiting the movement of the backing pad to an orbital movement.

The operating state in which the motor of the power tool is running and the power tool is in an idle state means that a bottom surface of the backing pad with the abrasive or polishing member is not resting or pressed against the surface of the workpiece to be worked. In contrast thereto, during the intended use of the power tool, the bottom surface of the backing pad with the abrasive or polishing member rests or is pressed without excessive force against the surface of the workpiece to be worked. This may slow down the backing pad's movement in respect to the means for transforming the rotational movement of the motor shaft into the orbital or random orbital movement of the backing pad (e.g. the eccentric element) and in respect to the housing of the power tool. Therefore, the magnetic force acting between the first and second magnetic elements provided at the housing and the backing pad is so strong that the at least one second magnetic element is held at a distance to the at least two first magnetic elements exclusively by means of the magnetic force at least when the motor of the power tool is running and the power tool is in an idle state. Hence, the movement of the backing pad is limited to an orbital movement without any contact between the housing and the backing pad resulting in a power tool according to the invention having an enhanced efficiency.

Positioning of the magnetic elements spaced apart from each other in a direction extending essentially parallel to the plane of movement and the extension plane of the backing pad, enables a particular efficient use of the magnetic force for slowing down a rotational movement of the backing pad and enforcing the orbital movement. Overcoming a magnetic force acting parallel to a plane of movement is much more difficult than if the magnetic force acted perpendicular to the plane of movement. In the second case the magnetic force could rather easily be overcome by applying a force to the backing pad directed in a transversal direction in respect to the magnetic force, viz. in the direction of the plane of movement of the backing pad.

Of course, the orbital movement of the backing pad in respect to the housing is not inhibited by the magnetic force acting between the first and second magnetic elements of the backing pad and the housing. To this end gaps are provided on both sides of the at least one second magnetic element between the at least one second magnetic element and the respective at least two first magnetic elements allowing an orbital movement between the backing pad and the housing, which is only restricted or limited by the magnetic force effective between the magnetic elements of the housing on the one hand and the respective magnetic elements of the backing pad on the other hand. During the orbital movement of the backing pad the gaps may become larger and smaller and/or the surfaces of the first and second magnetic elements facing each other may be moved transversally in respect to one another with constant gap dimensions. As the first magnetic elements are located in a fixed distance in respect to each other, when the one gap between one first magnetic element and the respective second magnetic element becomes smaller, the other gap between the other first magnetic element and the respective second magnetic element inevitably and automatically becomes larger.

According to preferred embodiment of the present invention it is suggested that the number, the magnetic characteristics, the dimensions and/or the position of the first and second magnetic elements are designed such that, at least when the motor of the power tool is running and the power tool is in an idle state, on the one hand the backing pad is able to perform the orbital movement in the extension plane of the backing pad and on the other hand contact between the magnetic elements is prevented. Preferably, the number, the magnetic characteristics, the dimensions and/or the position of the first and second magnetic elements are designed such that, during intended use of the power tool, on the one hand the backing pad is able to perform the orbital movement in the extension plane of the backing pad and on the other hand contact between the magnetic elements is prevented. Advantageously, the number, the magnetic characteristics, the dimensions and/or the position of the first and second magnetic elements are selected such that, even a shock or strong vibrations (created by the motor in co-operation with the eccentric element) must not bring the surfaces of the first and second magnetic elements facing each other into contact.

In order to avoid contact between the magnetic elements during the intended use even if the backing pad is pressed against the surface to be worked with excessive force, it is suggested that damping elements are provided between surfaces of the first and second magnetic elements directly facing each other. In that manner, a damaging of the surfaces of the first and second magnetic elements directly facing each other and the creation of a vibrating noise due to contact between the first and second magnetic elements can be avoided. Preferably, the damping elements are provided on the surfaces of the magnetic elements of the housing directly facing the respective magnetic elements of the backing pad. In this manner the vibrating masses of the backing pad can be reduced or are not enhanced by the damping elements, respectively. This leads to a significant reduction of the vibrations of the power tool during its intended use. It is further suggested that the damping elements are embodied as sheets of rubber, soft plastic or the like. Finally, it is suggested that at least part of the magnetic elements are permanent magnets or solenoids. In particular, the magnetic elements of the housing could be embodied as solenoids because a respective current for creating the magnetic field in the solenoids can be directly led to the solenoids from the power tool, in particular from the electric power supply of the power tool. If the magnetic elements of the backing pad are embodied as solenoids, a respective current could be created in the backing pad, for example by means of an induction coil provided in the backing pad and interacting with a magnetic field created by permanent magnets provided in the housing, thereby creating electric current for supplying the solenoids of the backing pad. Alternatively, the backing pad could be provided with one or more (e.g. rechargeable) batteries, which could provide the electric current for supplying the solenoids of the backing pad with electric current. Permanent magnets create a static magnetic field and are made of, for example, magnetized low carbon steel, cobalt, nickel, a ferrite or a Rare Earth Element.

According to a preferred embodiment of the present invention it is suggested that the housing or the backing pad comprises a first set of at least two first magnetic elements spaced apart from each other in a direction extending parallel to the extension plane of the backing pad, and that (if the housing has the first set of first magnetic elements) the backing pad or (if the backing pad has the first set of first magnetic elements) the housing comprises at least one second magnetic element located in the space between at least two first magnetic elements of the first set of first magnetic elements. The second magnetic element is located in the space between the first magnetic elements in such a manner that the at least one second magnetic element is held at a distance to the first set of first magnetic elements at least when the motor of the power tool is running and the power tool is in an idle state. The first set of the at least two first magnetic elements and the respective at least one second magnetic element are preferably located at a front region of the housing of the power tool.

According to an advantageous further embodiment of the invention it is suggested that besides the first set of first and second magnetic elements located at the front region of the housing, the housing or the backing pad additionally comprises a second set of at least two first magnetic elements spaced apart from each other in a direction extending parallel to the extension plane of the backing pad, and the backing pad or the housing comprises at least another second magnetic element located in the space between at least two first magnetic elements of the second set of first magnetic elements in such a manner that the second magnetic element is held at a distance to the second set of first magnetic elements at least when the motor of the power tool is running and the power tool is in an idle state. The second set of the at least two first magnetic elements and the respective at least one other second magnetic element are located at a rearward region of the housing of the power tool.

According to yet another advantageous embodiment of the invention it is suggested that besides the first set of first and second magnetic elements located at the front region of the housing, the housing or the backing pad comprises two second sets of at least two first magnetic elements spaced apart from each other in a direction extending parallel to the extension plane of the backing pad, and the backing pad or the housing comprises at least two other second magnetic elements each located in the space between at least two of the first magnetic elements of the second sets of first magnetic elements in such a manner that the second magnetic elements are each held at a distance to the respective second set of first magnetic elements at least when the motor of the power tool is running and the power tool is in an idle state. The two second sets of the at least two first magnetic elements and the respective at least two other second magnetic elements are located at opposite side regions of the power tool. Of course further sets of first and second magnetic elements with one, two or more magnetic elements each could be provided distributed along the circumference of the housing of the power tool. In particular, it would be possible to have a plurality of at least three first magnetic elements located next to one another in a given distance and a plurality of at least two second magnetic elements located in the spaces between the first magnetic elements.

Instead of the at least one other second magnetic element being located in a space between at least two first magnetic elements of the second set of first magnetic elements, it is also possible that the housing or the backing pad comprises a second set of only one first magnetic element, and the backing pad or the housing comprises one other second magnetic element spaced apart from the first magnetic element of the second set in a direction extending parallel to the extension plane of the backing pad wherein the other second magnetic element is held at a distance to the first magnetic element of the second set at least when the motor of the power tool is running and the power tool is in an idle state. This embodiment requires the interaction of the at least two first magnetic elements of the first set of first magnetic elements with the at least one second magnetic element located in between. The one first magnetic element of the second set, and the one other second magnetic element can provide for additional damping functionality in one direction extending parallel to the extension plane of the backing pad.

Preferably, the first magnetic element(s) and the second magnetic element(s) of the first and second set have opposing polarities in order to repel each other. Of course, the magnetic elements do not necessarily have to be located inside the housing and the backing pad, respectively. It is understood that the first magnetic elements are associated with the housing or the backing pad and the second magnetic elements are associated with the backing pad or the housing, respectively. How and where the magnetic elements are exactly fixed to the housing and the backing pad, respectively, is of no account for a proper functioning of the invention, as long as the magnetic forces between the first magnetic elements and the second magnetic elements associated to the housing and the backing pad, respectively, act in a direction parallel to the planar extension of the backing pad and to the plane of movement of the backing pad during intended use of the power tool.

Figure 2:
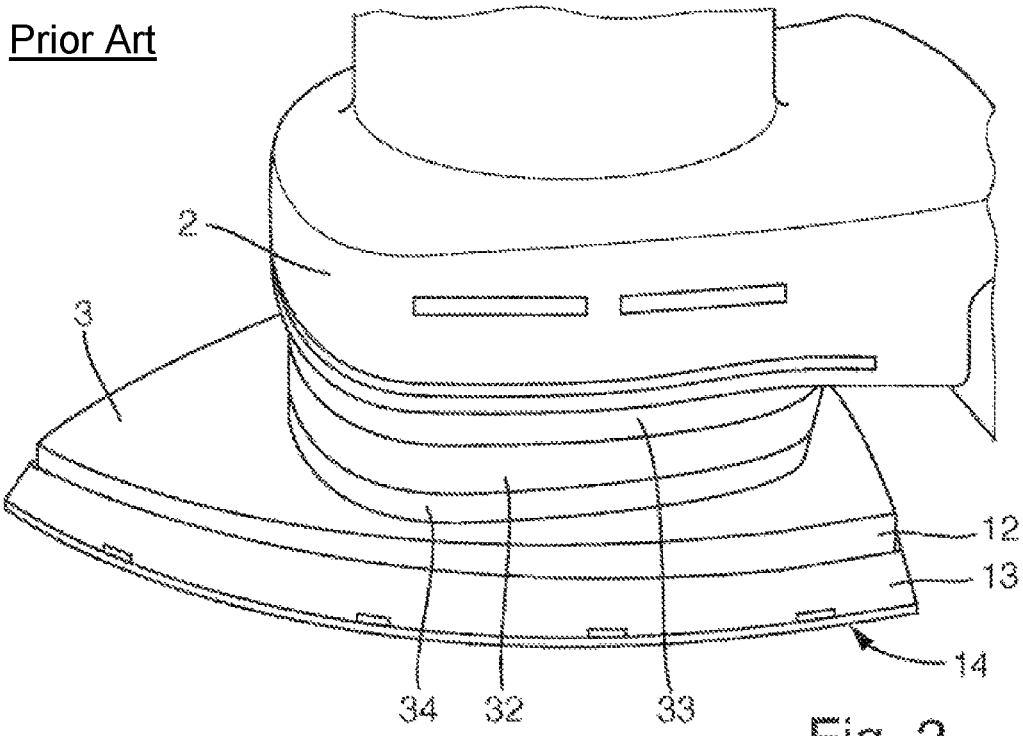
Figure 3:
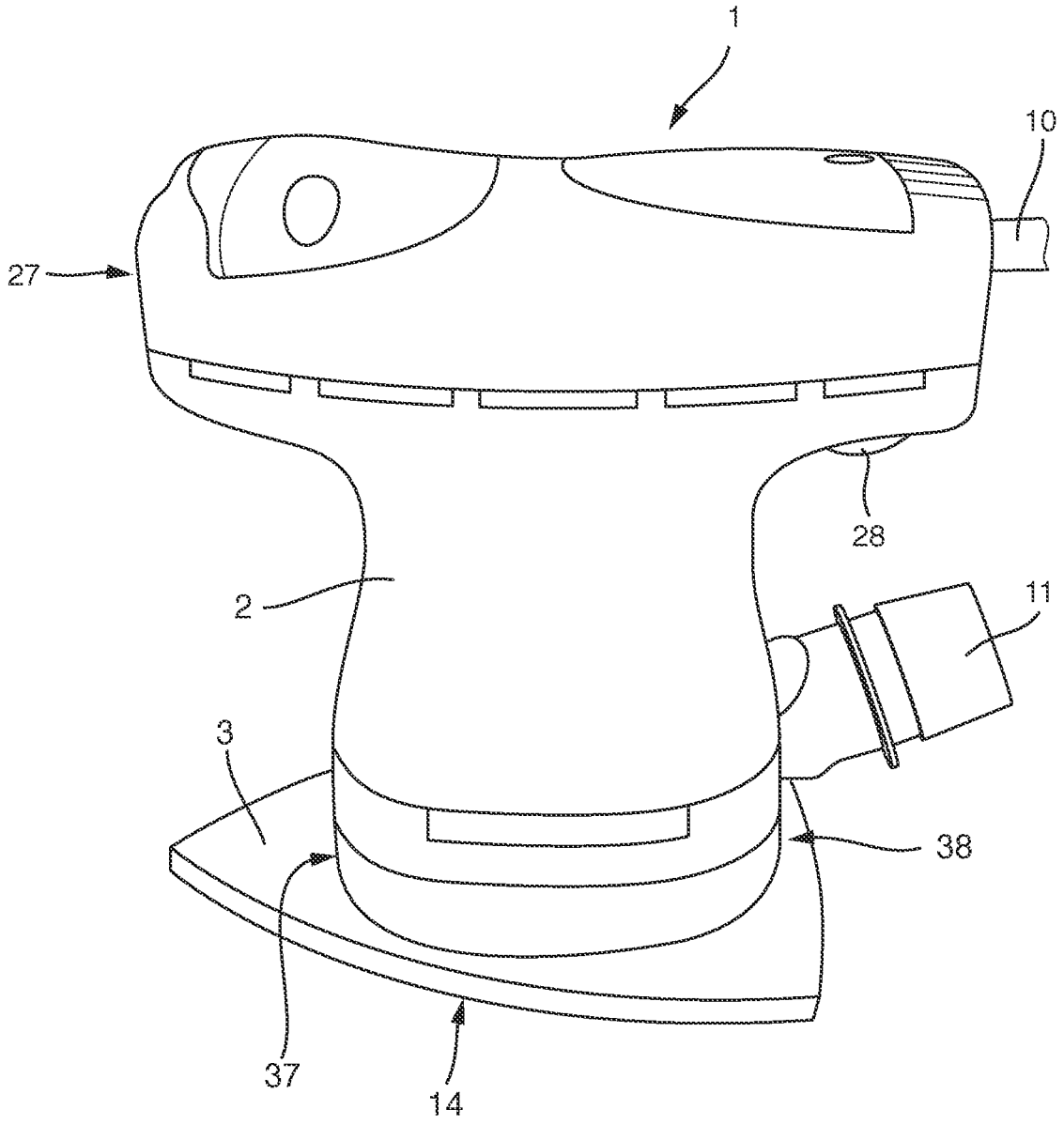
Figure 4:
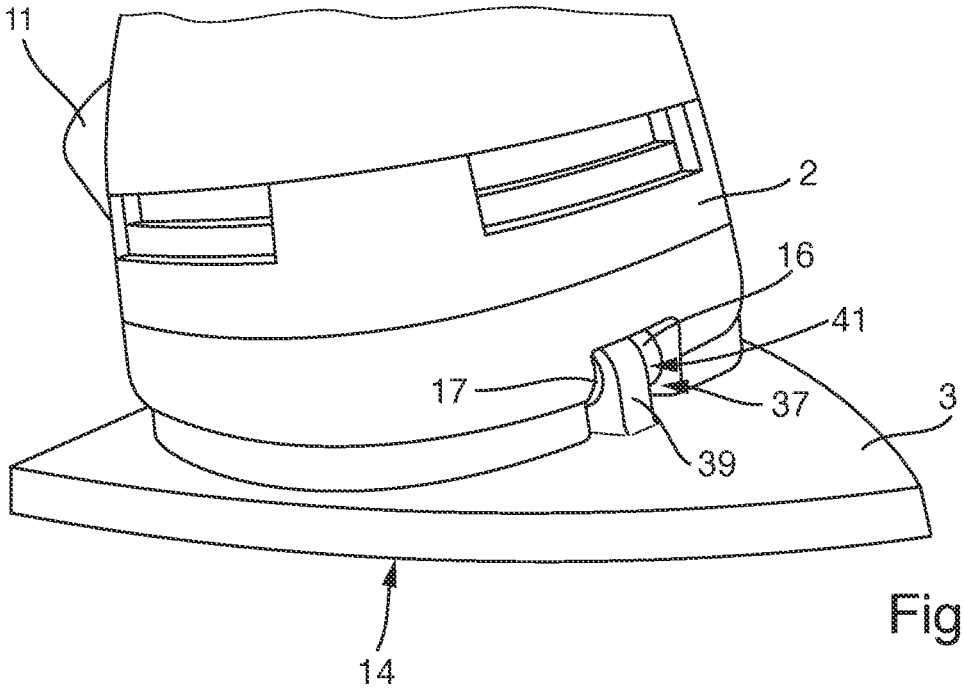
Figure 5:
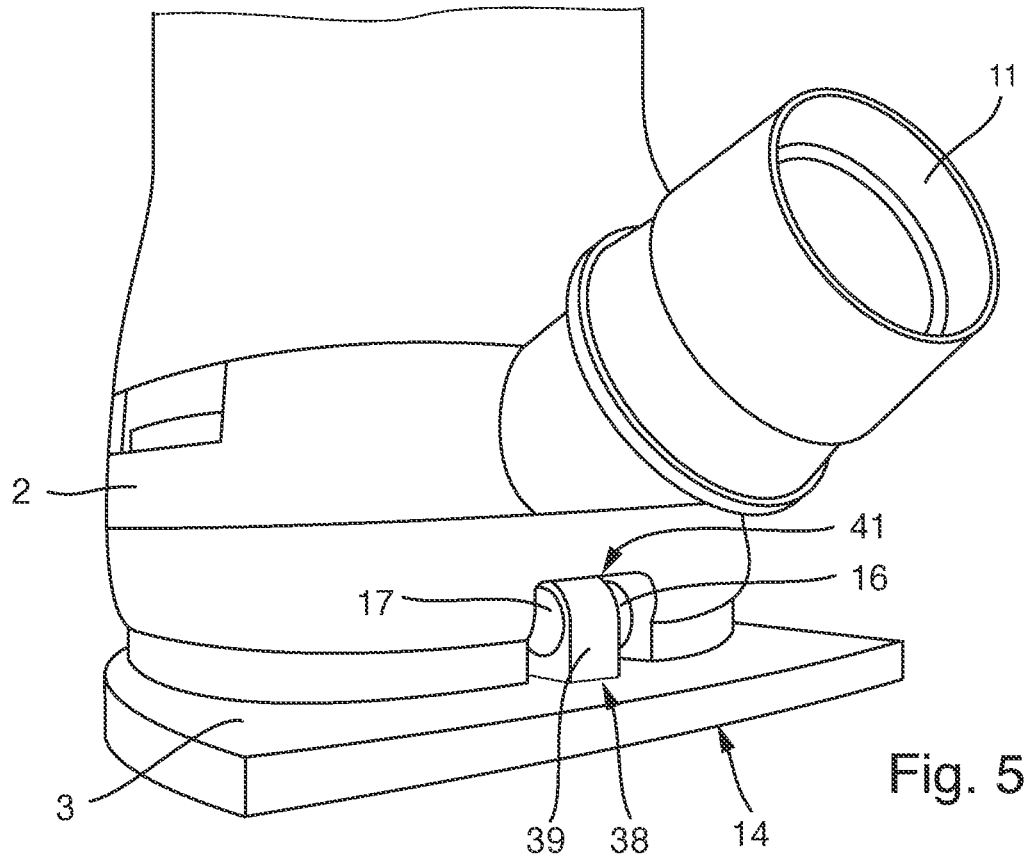
Figure 6:
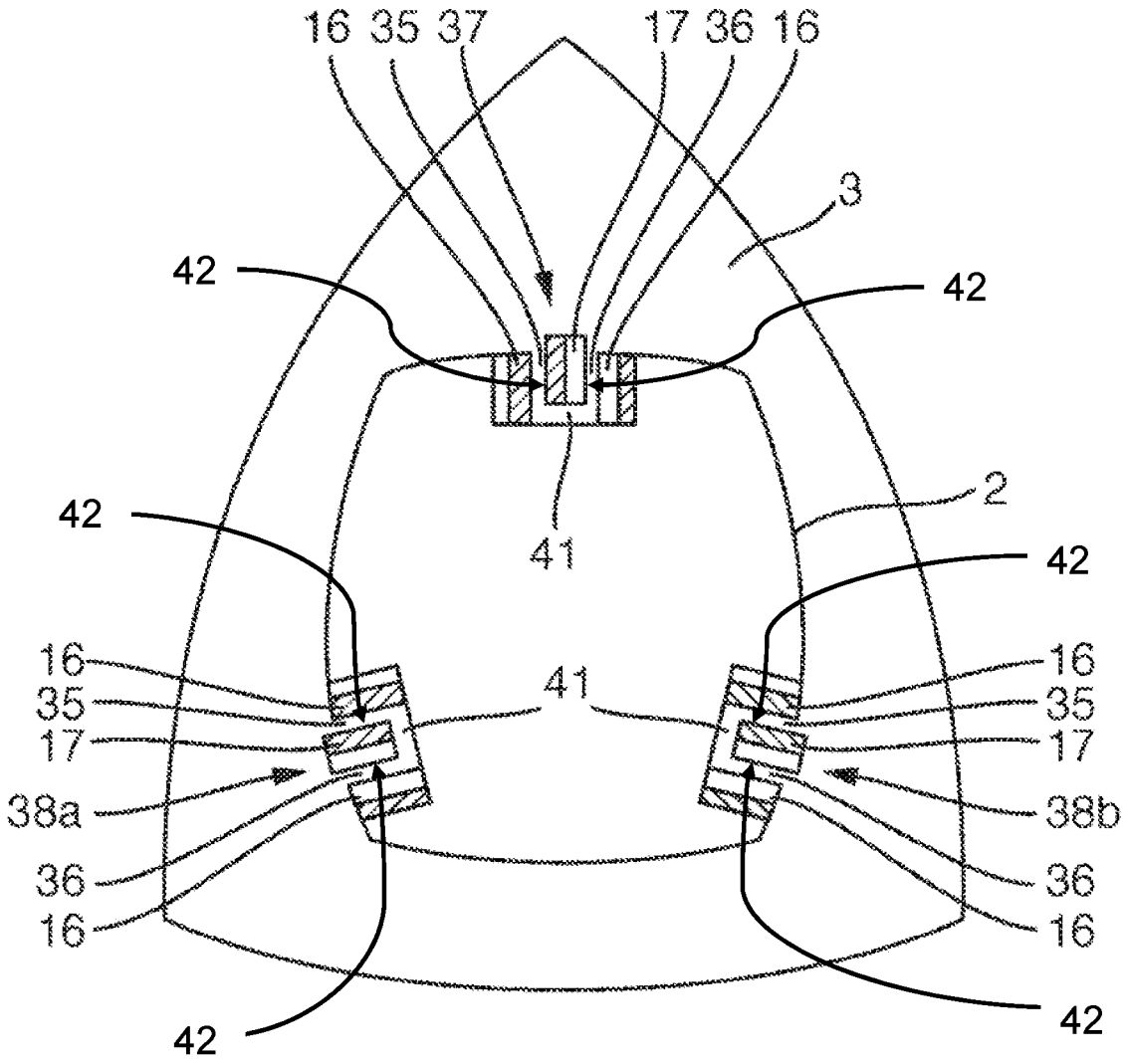
Figure 7:
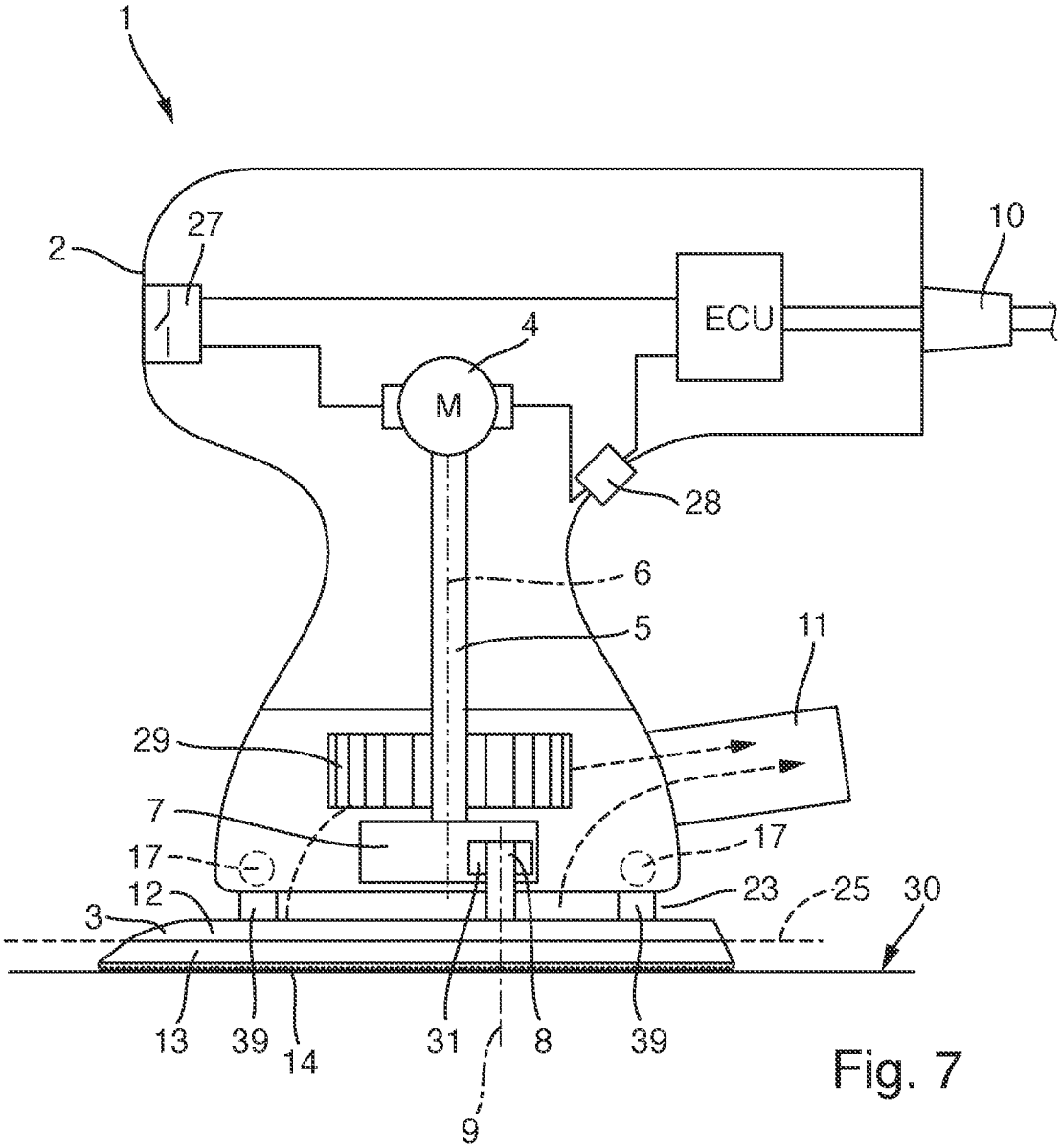

Further characteristics and advantages of the present invention are described hereinafter with reference to the accompanying drawings. The drawings show a two preferred embodiments of the present invention without, however, limiting the invention to the described embodiments. Rather, there are many possible alternative embodiments of the present invention besides the embodiments explicitly described hereinafter and shown in the figures. The figures show:

FIG. 1 a side view of an orbital sander known from the prior art having a delta-shaped backing pad;

FIG. 2 a detailed perspective view of the bottom part of the housing and the top surface of the backing pad of the known orbital sander of FIG. 1;

FIG. 3 a perspective side view of an orbital power tool according to the present invention in a first embodiment;

FIG. 4 a perspective front view of a detail of the orbital power tool of FIG. 3;

FIG. 5 a perspective rear view of a detail of the orbital power tool of FIG. 3;

FIG. 6 a sectional top view through the bottom part of the housing of an orbital power tool according to the present invention in another embodiment; and FIG. 7 a sectional side view through the orbital power tool of FIGS. 4 and 5.

With reference to FIGS. 1 and 2, an orbital sander known from the prior art is described. The known orbital sander 1 is the "Festool DTSC 400". It is one example for a known hand-held power tool 1 for sanding or polishing a workpiece. The orbital sander 1 comprises a housing 2 and a backing pad 3 adapted for performing an orbital or a random orbital movement in an extension plane 25 of the backing pad 3 in respect to the housing 2 during intended use of the sander 1. The sander 1 further comprises in the housing 2 and therefore not visible in the figures an electric motor 4 with a motor shaft 5 adapted for performing a rotational movement about an axis 6 of rotation, and means 7, 8 for transforming the rotational movement of the motor shaft 5 into the orbital movement of the backing pad 3.

The known orbital sander 1 of FIGS. 1 and 2 is equipped with a rechargeable battery 26 for providing electric current to the electric motor 4. The sander 1 also comprises a switch 27 for activating/deactivating the sander 1 and a controller 28, e.g. in the form of a knurled wheel, for controlling the speed of the motor 4 and of the orbital movement of the backing pad 3. The switch 27 and the controller 28 are accessible by a user of the sander 1 from outside the housing 2. Furthermore, the known sander 1 comprises a self-generated dust extraction system comprising venting means 29 in the inside of the housing 2 rotating about the axis 6 together with the motor shaft 5 and blowing dust generated during operation of the sander 1 from a working surface 30 to a dust suction connection tube 11. A hose from a vacuum cleaner or from any other dust suction device can be connected to the connection tube 11, in order to improve the dust extraction efficiency of the sander 1.

With reference to the FIGS. 3 to 7 a preferred embodiment of a hand-held and hand-guided power tool 1 according to the present invention is described. The power tool 1 shown by way of example in the FIGS. 3 to 7 is an orbital sander. However, the power tool 1 could also be embodied as any kind of power tool 1, whose backing pad 3 performs an orbital movement during the intended use of the power tool 1, for example as an orbital polisher. The form of the backing pad 3 has preferably a delta-shape (see FIG. 6) but could also have any other kind of shape, in particular a round, a rectangular or a triangular shape. The power tool 1 has the electric motor 4 which is provided with electric current by means of a mains power supply 10. However, the power tool 1 could also be equipped with a rechargeable battery, like battery 26 of the orbital sander 1 of FIGS. 1 and 2 known from the prior art, or with a pneumatic motor instead of an electric motor. In the latter case, instead of a mains power supply 10 or a battery 26, the power tool 1 would be provided with a compressed air socket for attachment of a high pressure hose providing compressed air for operating the pneumatic motor.

The power tool 1 comprises the housing 2 preferably made of plastic material. Of course, at least part of the housing 2 could be made of other materials, for example metal or carbon fibre. In particular, a top part of the housing 2 could have inserts made of resilient material, like rubber or soft plastic, in order to improve feel and tangibility of the housing 2 where it is gripped by the user during intended use of the power tool 1. Further, the power tool 1 comprises the backing pad 3 adapted for performing an orbital movement in respect to the housing 2. Within the housing 2 the power tool 1 comprises the electric motor 4 with the motor shaft 5 adapted for performing a rotational movement about the axis 6 of rotation. Further, means 7 for transforming the rotational movement of the shaft 5 into the orbital movement of the backing pad 3 are provided. In this embodiment the transforming means 7 comprise an eccentric element. A guiding pin 8 of the backing pad 3 is supported in the eccentric element 7 by means of bearings 31 in a manner freely rotatable about a longitudinal axis 9 in respect to the eccentric element 7. The guiding pin 8 is located eccentrically to the rotational axis 6 of the motor shaft 5. Of course, the transforming means 7, 8 could be embodied as any other kind of appropriate gear mechanism, too.

The backing pad 3 preferably comprises a planar base plate 12 made of a rigid material (e.g. plastic and/or metal), a planar absorption plate 13 attached to a bottom surface of the base plate 12 and made of a resilient material (e.g. soft plastic or rubber), and a preferably sheet-like abrasive member 14 attached to a bottom surface of the absorption plate 13. Of course, in the case of an orbital polisher, instead of the abrasive member 14, a pad-like polishing member would be attached to the bottom surface of the backing pad 3. Holes may be provided in the member 14 and in the backing pad 3 in order to allow the aspiration of dust from the working surface 30 by the venting means 29 and discarding of the aspired dust through the dust suction connection tube 11.

The backing pad 3 is supported in respect to the eccentric element 7 and the housing 2, respectively, such that it is able to rotate about a longitudinal axis, which corresponds to the longitudinal axis 9 of the guiding pin 8. However, in order to achieve the desired orbital movement of the backing pad 3, means for preventing the free rotational movement of the backing pad 3 about the axis 9 in respect to the housing 2 have to be provided. In the case of the known orbital sander "Festool DTS 400" shown in FIGS. 1 and 2, mechanical means for preventing the backing pad 3 from freely rotating in respect to the housing 2 of the power tool 1 are provided which comprise a flexible rubber band 32 bridging a gap 23 between a top surface of the backing pad 3 and a bottom part of the housing 2 facing the top surface of the backing pad 3, the rubber band 32 being fixedly connected to the housing 2 as well as to the backing pad 3. In particular, clamping rings 33, 34 are provided with which the rubber band 32 may be attached to the bottom outer surface of the housing 2 and to an outer surface of a rim provided on the top surface of the backing pad 3. Due to the presence of the rubber band 32 only a restricted rotational movement of the backing pad 3 in respect to the housing 2 about the longitudinal axis 9 is possible. On the other hand, the elasticity of the rubber band 32 allows an orbital movement of the backing pad 3 in the plane of extension 25 of the backing pad 3.

The present invention suggests different means for preventing the free rotational movement of the backing pad 3 about the axis 9 in respect to the housing 2. In particular, the means suggested by the invention function contactless and provide for a reduced mechanical loss and an enhanced efficiency of the power tool 1. In accordance with the present invention it is suggested that the backing pad 3 is supported in respect to the housing 2 of the power tool 1 in a manner freely rotatable about the longitudinal axis 9 extending perpendicular to the extension plane 25 of the backing pad 3. As can be seen in FIG. 6, in the present embodiment, the housing 2 comprises two first magnetic elements 16 spaced apart from each other in a direction extending parallel to the extension plane 25 of the backing pad 3. In FIG. 6 the magnetic elements 16 are embodied as permanent magnets. Permanent magnets create a static magnetic field and are made of, for example, magnetized low carbon steel, cobalt, nickel, a ferrite or a Rare Earth Element. In the drawings, the north poles N of the magnetic elements 16 are coloured in black, the south poles S in white. The backing pad 3 comprises one second magnetic element 17 located in a space 41 between the two first magnetic elements 16 in such a manner that the second magnetic element 17 is held at a distance to the two first magnetic elements 16 by means of magnetic force acting between the magnetic elements 16, 17 at least when the motor 4 of the power tool 1 is running and the power tool 1 is in an idle state, thereby limiting the movement of the backing pad 3 to an orbital movement. Of course, it would also be possible that the first magnetic elements 16 are attached to the backing pad 3 and that the second magnetic element 17 is attached to the housing 2. Furthermore, it would be possible that at least some of the magnetic elements 16, 17 are embodied as solenoids. Finally, where in FIG. 6 only one magnetic element 16, 17 is shown, there could be provided more than one magnetic element 16, 17.

The operating state in which the motor 4 of the power tool 1 is running and the power tool 1 is in an idle state means that a bottom surface of the backing pad 3 with the abrasive or polishing member 14 is not resting or pressed against the working surface 30 of the workpiece to be worked. In contrast thereto, during the intended use of the power tool 1, the bottom surface of the backing pad 3 with the abrasive or polishing member 14 rests or is pressed without excessive force against the surface 30 of the workpiece to be worked. This may slow down the backing pad's rotational movement about the longitudinal axis 9 in respect to the eccentric element 7 and in respect to the housing 2 of the power tool 1. Therefore, the magnetic force acting between the first and second magnetic elements 16, 17 provided at the housing 2 and the backing pad 3 is so strong that the at least one second magnetic element 17 is held at a distance to the at least two first magnetic elements 16 exclusively by means of the magnetic force at least when the motor 4 of the power tool 1 is running and the power tool 2 is in an idle state. Hence, the movement of the backing pad 3 is limited to an orbital movement without any contact between the housing 2 and the backing pad 3 resulting in a power tool 1 having an enhanced efficiency.

Of course, the orbital movement of the backing pad 3 in respect to the housing 2 is not completely inhibited by the magnetic force acting between the first and second magnetic elements 16, 17 of the backing pad 3 and the housing 2. To this end gaps 35, 36 are provided on both sides of the second magnetic element 17 between the second magnetic element 17 and the respective two first magnetic elements 16 permitting an orbital movement between the backing pad 3 and the housing 2, which is only restricted or limited by the magnetic force effective between the magnetic elements 16 of the housing 2 on the one hand and the respective magnetic elements 17 of the backing pad 3 on the other hand. During the orbital movement of the backing pad 3 the end gaps 35, 36 may become larger and smaller and/or the surfaces of the first and second magnetic elements 16, 17 facing each other may be moved transversally in respect to one another with constant dimensions of the end gaps 35, 36. As the first magnetic elements 16 are located at a fixed distance in respect to each other, when the one gap 35 of the end gaps 35, 36 between one first magnetic element 16 and the respective second magnetic element 17 becomes smaller, the other gap 36 of the end gaps 35, 36 between the other first magnetic element 16 and the respective second magnetic element 17 inevitably and automatically becomes larger and vice versa when the one gap 35 of the end gaps 35, 36 becomes larger, the other gap 36 of the end gaps 35, 36 becomes smaller.

Advantageously, the number, the magnetic characteristics, the dimensions and/or the position of the first and second magnetic elements 16, 17 are selected such that, even a shock or strong vibrations (created by the motor 4 in co-operation with the eccentric element 7) must not bring the surfaces of the first and second magnetic elements 16, 17 facing each other into contact. In any case, this is valid for the power tool 1 in its idle state, but preferably is also valid for the power tool 1 during its intended use with the power tool 1 and the backing pad 3 not being pressed onto the working surface 30 with excessive force.

In order to avoid contact between the magnetic elements 16, 17 during the intended use of the power tool 1 even if the backing pad 3 is pressed against the surface 30 to be worked with excessive force, it is suggested that damping elements 42 (FIG. 6) are provided between surfaces of the first and second magnetic elements 16, 17 directly facing each other. In that manner, a damaging of the surfaces of the first and second magnetic elements 16, 17 directly facing each other and/or the creation of a vibrating noise due to contact between the first and second magnetic elements 16, 17 can be avoided. Preferably, the damping elements 42 are provided on the surfaces of the magnetic elements 16 of the housing 2 directly facing the respective magnetic elements 17 of the backing pad 3. It is suggested that the damping elements 42 are embodied as sheets of rubber, soft plastic or the like.

It is suggested that the housing comprises a first set 37 of at least two first magnetic elements 16 spaced apart from each other in a direction extending parallel to the extension plane 25 of the backing pad 3, and that the backing pad 3 comprises at least one second magnetic element 17 located in the space 41 between at least two first magnetic elements 16 of the first set 37 of first magnetic elements 16. The second magnetic element 17 is located in the space 41 between the first magnetic elements 16 in such a manner that the second magnetic element 17 is held at a distance to the first set 37 of first magnetic elements 16 at least when the motor 4 of the power tool 1 is running and the power tool 1 is in an idle state. In particular, it is suggested that the surfaces of the first magnetic elements 16 and the second magnetic element 17 facing each other have opposing polarities. The first set 37 of the at least two first magnetic elements 16 and the respective at least one second magnetic element 17 are preferably located at a front region of the housing 2 of the power tool 1.

According to the embodiment of FIG. 6, the housing 2 comprises two second sets 38*a*, 38*b* of two first magnetic elements 16 spaced apart from each other in a direction extending parallel to the extension plane 25 of the backing pad 3. The backing pad 3 comprises two other second magnetic elements 17 each located in the space 41 between at least two of the first magnetic elements 16 of the second sets 38*a*, 38*b* of first magnetic elements 16 in such a manner that the second magnetic elements 17 are each held at a distance to the respective second set 38*a*, 38*b* of first magnetic elements 16 at least when the motor 4 of the power tool 1 is running and the power tool 1 is in an idle state. The two second sets 38*a*, 38*b* of the at least two first magnetic elements 16 and the respective at least two other second magnetic elements 17 are located at opposite side regions of the power tool 1. In particular, on second set 38*a* of magnetic elements 16, 17 is located on a left side of the power tool 1 and another set 38*b* of magnetic elements 16, 17 is located on the opposite right side of the power tool 1. Of course further sets of first and second magnetic elements 16, 17 could be provided distributed along the circumference of the housing 2 of the power tool 1.

Alternatively, the two second sets 38*a*, 38*b* could comprise only one first magnetic element 16 each with one other second magnetic element 17 located at a distance in respect to the first magnetic element 16 of second set 38*a* and another second magnetic element 17 located at a distance in respect to the first magnetic element 16 of the other second set 38*b*. Finally, it would also be possible that the two second sets 38*a*, 38*b* each comprise a plurality of at least three first magnetic elements 16 located next to each other at a given distance in a plane extending parallel to the plane of extension 25 of the backing pad 3 and that the backing pad 3 comprises a plurality of at least two second magnetic elements 17 located in the spaces between the first magnetic elements 16. This allows realization of the invention with weaker and cheaper magnetic elements 16, 17. Again, the surfaces of the first magnetic elements 16 and the second magnetic element 17 facing each other have opposing polarities.

It is emphasized that the magnetic elements 16, 17 do not necessarily have to be located inside the housing 2 and the backing pad 3, respectively. It is understood that the first magnetic elements 16 are associated with the housing 2 or the backing pad 3 and the second magnetic elements 17 are associated with the backing pad 3 (in case the first magnetic elements 16 are associated with the housing 2) or the housing (in case the first magnetic elements 16 are associated with the backing pad 3), respectively. How and where the magnetic elements 16, 17 are exactly fixed to the housing 2 and the backing pad 3, respectively, is of no account for a proper functioning of the invention, as long as the magnetic forces between the first magnetic elements 16 and the second magnetic elements 17 associated to the housing 2 and the backing pad 3, respectively, act in a direction parallel to the planar extension of the backing pad 3 and to the plane of movement of the backing pad 3 during intended use of the power tool 1.

In the embodiment shown in FIGS. 3 to 5 and 7, besides the first set 37 of first and second magnetic elements 16, 17 located at the front region of the housing 2 (see FIG. 4), the housing 2 additionally comprises a second set 38 of two first magnetic elements 16 spaced apart from each other in a direction extending parallel to the extension plane 25 of the backing pad 3. The backing pad 3 comprises another second magnetic element 17 located in the space 41 between the two first magnetic elements 16 of the second set 38 of first magnetic elements 16 in such a manner that the second magnetic element 17 is held at a distance to the second set 38 of first magnetic elements 16 at least when the motor 4 of the power tool 1 is running and the power tool 1 is in an idle state. The second set 38 of the two first magnetic elements 16 and the respective other second magnetic element 17 are located at a rearward region of the housing 2 of the power tool 1, in the shown embodiment below the rear dust suction connection tube 11. This embodiment has the advantage that less sets of magnetic elements 16, 17 are necessary, thereby saving costs for material and assembly of the power tool 1, reducing the moving masses of the backing pad 3 and consequently the vibrations of the power tool 1 and finally reducing installation space necessary for mounting the various sets of magnetic elements 16, 17 to the power tool 1 as well as weight.

According to the present invention it is suggested that for each set of magnetic elements 16, 17 a recess 40 is provided in the bottom part of the housing 2 facing the backing pad 3. The first magnetic elements 16 are attached to lateral surfaces of the recess 40 facing each other with opposing polarities. Further, for each set of magnetic elements 16, 17, the top surface of the backing pad 3 is provided with a protruding element 39 extending perpendicular to the extension plane 25 of the backing pad 3 into the recess 40. The recess 40 has a larger lateral extension than the protruding element 39, in order to allow a limited movement of the element 39 in the recess 40 and, consequently, of the backing pad 3 in respect to the housing 2. The second magnetic element 17 is attached to the protruding element 39 in a manner, that the surfaces facing the first magnetic elements 16 have polarities opposite to the polarities of the surfaces of the first magnetic elements 16 facing the second magnetic element 17. This can be seen in FIG. 6, where the different polarities of the magnetic elements 16, 17 are shown with shadings and without shadings, respectively. The backing pad 3 is held in the eccentric element 7 by means of the bearings 31 in a direction perpendicular to the extension plane 25 of the backing pad 3 (parallel to the longitudinal axis 9), thereby holding the protruding element 39 with the second magnetic element 17 within the recess 40 with the first magnetic elements 16 despite the opposite polarities of the magnetic elements 16, 17. Hence, the second magnetic element 17 is held in a distance to the first magnetic elements 16, during the orbital movement of the backing pad 3.

The design of the power tool 1 of the embodiment is such that even with no magnetic elements 16, 17 provided in the housing 2 and the backing pad 3, respectively, the backing pad 3 still would not be able to realize a random orbital movement due to the lateral surfaces of the protruding element 39 abutting against the lateral surfaces of the recess 40. Furthermore, a free rotation of the backing pad 3 about the longitudinal axis 9 is possible only in the rather restricted path defined by the lateral surfaces of the protruding element 39 abutting against the lateral surfaces of the recess 40. In particular, a rotation of the backing pad 3 about the axis 9 into different rotational positions is not possible.

The invention claimed is:

1. Hand-held power tool (1) for sanding or polishing a working surface (30) of a workpiece, the hand-held power tool (1) comprising a housing (2) and a backing pad (3) adapted for performing an orbital or a random orbital movement in an extension plane (25) of the backing pad (3) in respect to the housing (2) during use of the hand-held power tool (1), and the hand-held power tool (1) further comprising in the housing (2)

a motor (4) with a motor shaft (5) adapted for performing a rotational movement about an axis of rotation (6), and means (7, 8) for transforming the rotational movement of the motor shaft (5) into the orbital or random orbital movement of the backing pad (3), the backing pad (3) being supported in respect to the housing (2) of the hand-held power tool (1) in a manner freely rotatable about a longitudinal rotational axis (9) extending perpendicular to the extension plane (25) of the backing pad (3), wherein the housing (2) or the backing pad (3) comprises at least two sets of first magnetic elements (16), the first magnetic elements of each set spaced apart from and facing each other in a circumferential direction extending in a second plane extending parallel to, and at an axial distance from, the extension plane (25) of the backing pad (3), a space (41) between the first magnetic elements of each set (16) extending in the circumferential direction by less than 45% and the backing pad (3) or the housing (2) comprises at least one second magnetic element (17) located in the second plane and in the space (41) between the first magnetic elements (16) of each set in such a manner that the at least one second magnetic element (17) is held at a distance to the first magnetic elements (16) by means of a magnetic force acting in the circumferential direction around the longitudinal rotational axis (9) at least when the motor (4) of the hand-held power tool (1) is running and the hand-held power tool (1) is in an idle state, thereby limiting the movement of the backing pad (3) to an orbital movement.

2. The hand-held power tool (1) according to claim 1, wherein at least one of the number, magnetic characteristics, dimensions and position of the first magnetic elements (16) and the at least one second magnetic element (17) are configured such that, at least when the motor (4) of the hand-held power tool (1) is running and the hand-held power tool (1) is in an idle state, the backing pad (3) is configured to perform the orbital movement in the extension plane (25) of the backing pad (3) and to prevent contact between the first magnetic elements (16) and the at least one second magnetic element (17).

3. The hand-held power tool (1) according to claim 1, wherein at least one of the number, magnetic characteristics, dimensions and position of the first magnetic elements (16) and the at least one second magnetic element (17) are configured such that, during use of the hand-held power tool (1), the backing pad (3) is configured to perform the orbital movement in the extension plane (25) of the backing pad (3) and to prevent contact between the first magnetic elements (16) and the at least one second magnetic element (17).

4. The hand-held power tool (1) according to claim 1, wherein the hand-held power tool (1) comprises damping elements (42) located between corresponding surfaces of the first magnetic elements (16) and a respective surface of the at least one second magnetic element (17) directly facing each other.

5. The hand-held power tool (1) according to claim 4, wherein the damping elements are located on at least one of the corresponding surfaces of the at least two first magnetic elements (16) and the respective surface of the at least one second magnetic element (17).

6. The hand-held power tool (1) according to claim 4, wherein the damping elements are made from sheets of rubber or soft plastic.

7. The hand-held power tool (1) according to claim 1, wherein at least some of the first magnetic elements (16) and the at least one second magnetic element (17) are permanent magnets or solenoids.

8. The hand-held power tool (1) according to claim 1, wherein a first part of the hand-held power tool (1) consisting of the housing (2) or the backing pad (3) comprises a first set (37) of the first magnetic elements (16) spaced apart from each other in a direction extending parallel to the extension plane (25) of the backing pad (3), and a corresponding other part of the hand-held power tool (1) consisting of the backing pad (3) or the housing (2) comprises the at least one second magnetic element (17) located in the space (41) between the first magnetic elements (16) of the first set (37) in such a manner that the at least one second magnetic element (17) is held at a distance to the first set (37) of the first magnetic elements (16) at least when the motor (4) of the hand-held power tool (1) is running and the hand-held power tool (1) is in an idle state.

9. The hand-held power tool (1) according to claim 8, wherein the first part of the hand-held power tool (1) consisting of the housing (2) or the backing pad (3) comprises a second set (38) of the first magnetic elements (16) spaced apart from each other in a direction extending parallel to the extension plane (25) of the backing pad (3), and the corresponding other part of the hand-held power tool (1) consisting of the backing pad (3) or the housing (2) comprises at least another second magnetic element (17) located in the space (41) between the first magnetic elements (16) of the second set (38) in such a manner that the at least another second magnetic element (17) is held at a distance to the second set (38) of the first magnetic elements (16) at least when the motor (4) of the hand-held power tool (1) is running and the power tool (1) is in an idle state.

10. The hand-held power tool (1) according to claim 8, wherein the first part of the hand-held power tool (1) consisting of the housing (2) or the backing pad (3) comprises two second sets (38*a*, 38*b*) of at least two first magnetic elements (16) spaced apart from each other in a direction extending parallel to the extension plane (25) of the backing pad (3), and the corresponding other part of the hand-held power tool (1) consisting of the backing pad (3) or the housing (2) comprises at least two other second magnetic elements (17) each located in the space (41) between at least two of the first magnetic elements (16) of the second sets (38*a*, 38*b*) in such a manner that the at least two other second magnetic elements (17) are each held at a distance to the two second sets (38*a*; 38*b*) of the first magnetic elements (16) at least when the motor (4) of the hand-held power tool (1) is running and the hand-held power tool (1) is in an idle state.

11. The hand-held power tool (1) according to claim 8, wherein the first part of the hand-held power tool (1) consisting of the housing (2) or the backing pad (3) comprises a second set (38) of one first magnetic element (16), the corresponding other part of the hand-held power tool (1) consisting of the backing pad (3) or the housing (2) comprises one other second magnetic element (17) spaced apart from the one first magnetic element (16) of the second set (38) in a direction extending parallel to the extension plane (25) of the backing pad (3), and the one other second magnetic element (17) is held at a distance to the one first magnetic element (16) of the second set (38) at least when the motor (4) of the hand-held power tool (1) is running and the hand-held power tool (1) is in an idle state.

12. The hand-held power tool (1) according to claim 9, wherein the second set (38) of the at least one first magnetic element (16) and the at least one other second magnetic element (17) are located at a rearward region of the housing of the power tool (1).

13. The hand-held power tool (1) according to claim 2, wherein at least part of the first magnetic elements (16) and the at least one second magnetic element (17) are permanent magnets or solenoids.

14. The hand-held power tool (1) according to claim 2, wherein a first part of the hand-held power tool (1) consisting of the housing (2) or the backing pad (3) comprises a first set (37) of the first magnetic elements (16) spaced apart from each other in a direction extending parallel to the extension plane (25) of the backing pad (3), and a corresponding other part of the hand-held power tool (1) consisting of the backing pad (3) or the housing (2) comprises the at least one second magnetic element (17) located in the space (41) between the first magnetic elements (16) of the first set (37) in such a manner that the at least one second magnetic element (17) is held at a distance to the first set (37) of the first magnetic elements (16) at least when the motor (4) of the hand-held power tool (1) is running and the hand-held power tool (1) is in an idle state.

15. The hand-held power tool (1) according to claim 14, wherein the first part of the hand-held power tool (1) consisting of the housing (2) or the backing pad (3) comprises a second set (38) of the first magnetic elements (16) spaced apart from each other in a direction extending parallel to the extension plane (25) of the backing pad (3), and the corresponding other part of the hand-held power tool (1) consisting of the backing pad (3) or the housing (2) comprises at least another second magnetic element (17) located in the space (41) between the first magnetic elements (16) of the second set (38) in such a manner that the at least another second magnetic element (17) is held at a distance to the second set (38) of the first magnetic elements (16) at least when the motor (4) of the hand-held power tool (1) is running and the power tool (1) is in an idle state.

16. The hand-held power tool (1) according to claim 14, wherein the first part of the hand-held power tool (1) consisting of the housing (2) or the backing pad (3) comprises two second sets (38*a*, 38*b*) of at least two first magnetic elements (16) spaced apart from each other in a direction extending parallel to the extension plane (25) of the backing pad (3), and the corresponding other part of the hand-held power tool (1) consisting of the backing pad (3) or the housing (2) comprises at least two other second magnetic elements (17) each located in the space (41) between at least two of the first magnetic elements (16) of the second sets (38*a*, 38*b*) in such a manner that the at least two other second magnetic elements (17) are each held at a distance to the two second sets (38*a*; 38*b*) of the first magnetic elements (16) at least when the motor (4) of the hand-held power tool (1) is running and the hand-held power tool (1) is in an idle state.

17. The hand-held power tool (1) according to claim 14, wherein the first part of the hand-held power tool (1) consisting of the housing (2) or the backing pad (3) comprises a second set (38) of one first magnetic element (16), the corresponding other part of the hand-held power tool (1) consisting of the backing pad (3) or the housing (2) comprises one other second magnetic element (17) spaced apart from the one first magnetic element (16) of the second set (38) in a direction extending parallel to the extension plane (25) of the backing pad (3), and the one other second magnetic element (17) is held at a distance to the one first magnetic element (16) of the second set (38) at least when the motor (4) of the hand-held power tool (1) is running and the hand-held power tool (1) is in an idle state.

18. The hand-held power tool (1) according to claim 8, wherein the first set (37) of the first magnetic elements (16) and the at least one second magnetic element (17) are located at a front region of the housing (2) of the hand-held power tool (1).

19. The hand-held power tool (1) according to claim 14, wherein the first set (37) of the first magnetic elements (16) and the at least one second magnetic element (17) are located at a front region of the housing (2) of the hand-held power tool (1).

* * * * *